US007093318B2

(12) United States Patent
Konrad

(10) Patent No.: US 7,093,318 B2
(45) Date of Patent: Aug. 22, 2006

(54) DEVICE FOR CARRYING OUT WORK ON A SURFACE AND METHOD FOR OPERATING THE DEVICE

(75) Inventor: Jürgen Konrad, Ulm/Donau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 191 days.

(21) Appl. No.: 10/281,808

(22) Filed: Oct. 28, 2002

(65) Prior Publication Data

US 2003/0074752 A1 Apr. 24, 2003

Related U.S. Application Data

(63) Continuation of application No. PCT/EP01/03306, filed on Mar. 23, 2001.

(30) Foreign Application Priority Data

Apr. 26, 2000 (DE) ..... 100 20 503

(51) Int. Cl.
*A47L 1/02* (2006.01)

(52) U.S. Cl. ..... 15/319; 15/301; 15/340.3

(58) Field of Classification Search ..... 15/301, 15/302, 319, 340.1, 340.2, 340.3, 340.4
See application file for complete search history.

(56) References Cited

U.S. PATENT DOCUMENTS

| | | | | |
|---|---|---|---|---|
| 3,298,052 | A * | 1/1967 | Wolfe | 15/302 |
| 3,775,804 | A * | 12/1973 | Hoener, Jr. | 15/302 |
| 3,979,788 | A * | 9/1976 | Strausak | 15/1.7 |
| 4,306,329 | A * | 12/1981 | Yokoi | 15/319 |
| 4,797,969 | A * | 1/1989 | Caduff | 15/302 |
| 4,971,591 | A | 11/1990 | Raviv et al. | |
| 5,284,522 | A * | 2/1994 | Kobayashi et al. | 134/18 |
| 5,568,589 | A * | 10/1996 | Hwang | 706/52 |
| 5,682,640 | A * | 11/1997 | Han | 15/319 |
| 5,781,960 | A * | 7/1998 | Kilstrom et al. | 15/319 |
| 5,890,250 | A * | 4/1999 | Lange et al. | 15/50.3 |
| 6,170,109 | B1 * | 1/2001 | Jesadanont et al. | 15/50.3 |
| 6,550,090 | B1 * | 4/2003 | Jesadanont et al. | 15/50.3 |
| 6,605,156 | B1 * | 8/2003 | Clark et al. | 134/6 |
| 2001/0004719 | A1 * | 6/2001 | Sommer | 701/23 |

FOREIGN PATENT DOCUMENTS

| | | |
|---|---|---|
| DE | 1 817 917 | 11/1973 |
| DE | 27 37 619 A1 | 3/1979 |
| DE | 297 80 307 U1 | 9/1997 |
| DE | 198 35 038 C1 | 7/1999 |
| EP | 0 541 951 A1 | 5/1993 |

(Continued)

*Primary Examiner*—Terrence R. Till
(74) *Attorney, Agent, or Firm*—Laurence A. Greenberg; Werner H. Stemer; Ralph E. Locher

(57) ABSTRACT

To treat a surface by a device attracted to the surface by vacuum, it is necessary in most cases to guide a working device with a certain contact pressure over the surface. To be able to set the contact pressure of the working device with little effort, the device according to the invention rests at three points on the surface, one support point being formed by the working device. The force of attraction of the device against the surface is, therefore, accurately distributed to the working device and the other two supports so that the pressure force of the working device can be specifically varied and also controlled by varying the vacuum between the device and the surface.

21 Claims, 1 Drawing Sheet

FOREIGN PATENT DOCUMENTS

JP 08 010 189 1/1996

WO WO 00/07492 * 2/2000

* cited by examiner

DEVICE FOR CARRYING OUT WORK ON A SURFACE AND METHOD FOR OPERATING THE DEVICE

CROSS-REFERENCE TO RELATED APPLICATION

This application is a continuation of copending International Application No. PCT/EP01/03306, filed Mar. 23, 2001, which designated the United States and was not published in English.

BACKGROUND OF THE INVENTION

Field of the Invention

The invention relates to a device for carrying out work on a surface and method for operating such a device, having measures for producing a vacuum between the device and the surface, at least one support for supporting against the surface, and a working device for treating the surface.

U.S. Pat. No. 4,971,591, in particular, discloses a device having a working device for washing windows or painting surfaces. In most cases, contact must generally be made with the surface for the treatment, special requirements for the contact pressure of the working device against the surface usually being imposed, as can be the case, in particular, during cleaning work. To such an end, the generic prior art devices are configured as vehicles, which can also move on their own over the surface and to which the working device is fastened. These prior art devices have, in particular, the disadvantage that, to press the working device against the surface, further measures are necessary, which constitutes a technical and financial outlay. Such outlay is, again, increased if the pressure force is to have a certain value.

SUMMARY OF THE INVENTION

It is accordingly an object of the invention to provide a device for carrying out work on a surface and method for operating such a device that overcome the hereinaforementioned disadvantages of the heretofore-known devices and methods of this general type and that, with little outlay, allows the working device to be pressed with a predetermined force against the surface to be treated.

With the foregoing and other objects in view, there is provided, in accordance with the invention, a device for carrying out work on a surface, including a housing, a vacuum disposed at the housing and producing a vacuum between the housing and the surface, a working device for treating the surface, the working device connected to the housing, at least one support connected to the housing for supporting the housing against the surface, and the working device and the at least one support supporting the housing against the surface in a three-point support.

According to the invention, the device is also supported against the surface by the working device, and the working device and the at least one support form a three-point support. As such, mechanical redundancy of the support of the device on the surface is avoided, the working device pressed against the surface being included in the support so that a special device for the contact pressure of the working device is unnecessary. A defined pressure force of the working device against the surface can be produced in an especially advantageous manner by the measures for producing a vacuum between the device and the surface, such measures being present anyway. The pressure force, caused by the vacuum, of the device against the surface is distributed to the at least one support and the working device in accordance with the geometrical configuration relative to one another. At a given distribution of the pressure force, the pressure force of the working device can, therefore, be varied in an especially simple manner by controlling the vacuum-producing device. Such a device may be, for example, a fan, the rotary speed and suction capacity of which can be varied.

In accordance with another feature of the invention, two supports are provided, and these supports together with the working device substantially form an isosceles triangle, the base of which extends between the two supports. However, the working device need not be solely of a point-like configuration, but, on the contrary, may have an elongated surface to be able to treat a larger surface simultaneously. In such a case, the surface-pressure center point corresponds to the support point of the working device. If the working device is of a planar construction, a floating or articulated mounting for the working device may be provided in such a case, for example, in the form of a rubber bearing or a cardanic suspension that cannot transmit any torque. This can ensure that the working device can only exert a supporting force on the device that acts perpendicularly to the surface and cannot exert a tilting moment, which could influence the load distribution between the two supports.

The triangular configuration of the support points ensures high stability of the device on the surface and avoids mechanical redundancy with regard to the support. The vacuum force is distributed to the supports or the working device in inverse ratio to the distance of the point of application of the vacuum force from the triangle base between the supports or from the support point of the working device. By simple application of the lever principle, it is, thus, possible to determine the pressure force, caused by a certain vacuum force, of the working device.

As an alternative to the previous embodiment, it is, likewise, possible to configure the working device in a planar manner and to provide only one support.

In particular, in accordance with a further feature of the invention, an elongated form of the working device may be selected in such a case, the extension of which lies next to the support point of the one support. In this embodiment having the same effect, the mechanical redundancy of the support is avoided by a combined section and point-like support, in which case, of the three points of the three-point support, one can be assigned to the one support and two can be assigned to the support section of the working device, in particular, to the two ends of the working device. In such a case, the support triangle is formed by the support and the outermost points of the working device, with which it rests on the surface.

To treat the surface at various locations, in accordance with an added feature of the invention, the device may have a drive that is advantageously formed by a support. As such, a separate drive, which must necessarily be in contact with the surface and could lead to mechanical redundancy, is not required. In an advantageously simple embodiment, the drive may be formed by a driven wheel having friction grip with the surface. To vary the direction of movement of the device on the surface, two spaced-apart drives may be provided, these drives being driven with different speeds and/or drive directions.

Despite this, however, in accordance with an additional feature of the invention, the drive direction of the drives may also be variable. As such, the direction of movement of the device on the surface can be varied even if only one drive is provided. In addition, with two drives variable in their drive direction, a movement of the device on the surface in various orientations is also possible.

To be able to determine the force with which the device is pressed against the surface on account of the vacuum, in accordance with yet another feature of the invention, there are provided measures for detecting the vacuum between the device and the surface. The pressure force of the device against the surface can be determined based upon the vacuum measured and the area measure acted upon by the vacuum. From such a force, in turn, by simple application of the lever principle, taking into account the configuration of the supports and of the working device relative to one another and, in particular, relative to the point of application of the vacuum force, the contact pressure of the working device can be determined and monitored. In the device according to the invention, there is a fixed relationship between the force of attraction of the device against the surface, which, in turn, depends on the vacuum produced, and the pressure force of the working device against the surface. For this reason, the pressure force of the working device against the surface can be controlled in an especially simple manner by varying the produced vacuum by activating the vacuum with a different output. If a suitable sensor is used, the vacuum between the device and the surface as well as, directly, the pressure force of the working device against the surface may be used as a controlled variable.

In accordance with yet a further feature of the invention, in addition, the device may have an inclination sensor. It can, thus, be established whether the device is in a vertical or horizontal position or is hanging upside down on a surface. The position of the device influences the relationship between the vacuum and the pressure force of the device against the surface because the force due to weight, depending on the position, can reduce the force of attraction. By taking into account the position detected by the inclination sensor, the influence of the position of the device on the pressure force can be compensated for, as is advantageous, in particular, during use on surfaces with different inclination. Preferably, the vacuum-detecting device is disposed at the housing.

In accordance with yet an added feature of the invention, there is provided a pressure detector for detecting a measure of a pressure force of the working device against the surface. Preferably, the pressure detector is disposed at the housing.

With the objects of the invention in view, there is also provided a device for carrying out work on a surface, including a housing, a means for producing a vacuum between the housing and the surface, the vacuum producing means disposed at the housing, a working device for treating the surface, the working device connected to the housing, at least one support connected to the housing for supporting the housing against the surface, and the working device and the at least one support supporting the housing against the surface in a three-point support.

With the objects of the invention in view, there is also provided a method for operating a device for carrying out work on a surface, including the steps of providing a housing having a vacuum, a working device for treating the surface, the working device having a support point, and at least one support having a support point for supporting the housing against the surface, the working device and the at least one support supporting the housing against the surface in a three-point support, and activating the vacuum to produce a pressure force against the surface, which pressure force, taking into account a point of application of the pressure force on the housing and a configuration of the support point of the at least one support and of the support point of the working device, leads to a predetermined pressure force of the working device against the surface.

In accordance with yet an additional mode of the invention, a measure of the vacuum between the housing and the surface is determined with a vacuum detecting device and utilizing the measure as an actual variable for controlling the vacuum.

In accordance with again another mode of the invention, a measure of the vacuum between the housing and the surface is determined with a pressure detector and utilizing the measure as an actual variable for controlling the vacuum.

In accordance with again a further mode of the invention, a measure of a pressure force of the working device against the surface is detected with a vacuum detecting device and utilizing the measure to achieve a predetermined value for the measure to control the vacuum.

In accordance with again an added mode of the invention, a measure of a pressure force of the working device against the surface is detected with a pressure detector and utilizing the measure to achieve a predetermined value for the measure to control the vacuum.

With the objects of the invention in view, there is also provided a method for operating a device for carrying out work on a surface, including the steps of providing a housing having a vacuum, a working device for treating the surface, the working device having a support point, and at least one support having a support point for supporting the housing against the surface, the working device and the at least one support supporting the housing against the surface in a three-point support, and activating the vacuum to produce pressure force against the surface and a corresponding predetermined pressure force of the working device against the surface dependent upon a point of application of the pressure force on the housing and a configuration of the support point of the at least one support and of the support point of the working device.

Other features that are considered as characteristic for the invention are set forth in the appended claims.

Although the invention is illustrated and described herein as embodied in a device for carrying out work on a surface, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
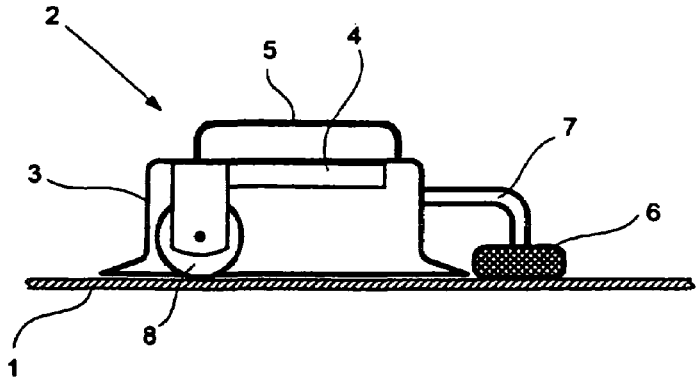
FIG. 1 is a diagrammatic, cross-sectional view of a first embodiment of the working device according to the invention.

Referring now to the figures of the drawings in detail and first, particularly to FIG. 1 thereof, there is shown the device 2 located in its working position on a surface 1 to be treated. The device 2 has a housing 3, in which a vacuum 4 (or fan) and two supporting or drive rollers 8 are accommodated. A cleaning device 6, as a working device, is fastened to the outside of the housing 3 by two struts 7. The device 2 rests on the surface 1 on the two drive rollers 8 and on the cleaning device 6. The housing 3 of the device 2 has the shape of a shell, the margins of which are at a slight distance from the surface 1. The housing 3, therefore, forms, together with the surface 1, a substantially closed space in which a vacuum can be produced by the vacuum 4, the vacuum 4 enabling the device 2 to be attracted to the surface 1. As such, the device 2 can also move vertically or upside down on the surface 1, as is required, for example, when cleaning vertically or horizontally disposed glass surfaces. A handle 5 for manipulating the device 2 is disposed at the top on the housing 3.

Figure 2:
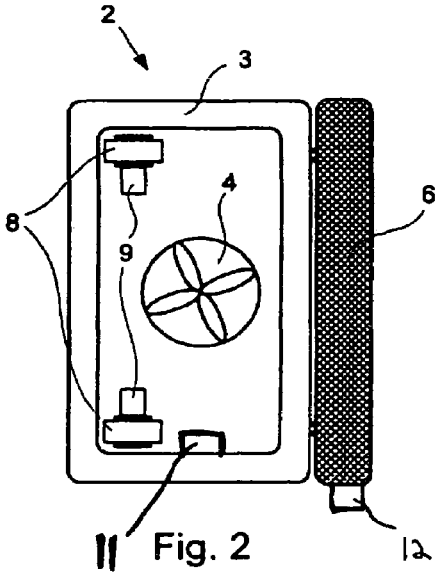
FIG. 2 is a plan view of the working device of FIG. 1 from below.

The device according to the invention in the first exemplary embodiment is shown from below in FIG. 2. The cleaning device 6 has an elongated narrow shape and extends along an entire side of the substantially rectangular device 2 in order to be able to simultaneously clean the largest possible sections of the surface 1. The two drive wheels 8 are each disposed on the side of the device 2 opposite the cleaning device 6, the two drive wheels 8 being at as large a distance from one another as possible. Both drive wheels 8 are respectively driven by a drive motor 9 and are provided with a coating that produces a friction grip between the drive wheels 8 and the surface 1.

When a vacuum is produced inside the housing 3 by the fan 4 during operation, the device 2 and the surface 1 are pressed together, such a force acting substantially at the area center of gravity of the surface clamped by the margin of the housing 3. Such attractive force is now distributed to the two drive wheels 8 and the cleaning device 6 according to a fixed relationship that depends on their spatial configuration relative to one another and with regard to the force initiation point. Because the device 2 rests on three supports—the two drive wheels 8 and the cleaning device 6—the pressure force of the cleaning device 6 is in direct relationship to the force of attraction of the device 2 to the surface 1. A measure of the vacuum can be set by suitable selection or activation of the fan 4, such a measure leading to the desired contact pressure of the cleaning device 6 against the surface 1. In addition, a vacuum sensor may be provided inside the housing 3, with which vacuum sensor 11 a suitable control circuit can control the vacuum or the pressure force of the cleaning device 6 with regard to an optimum set point.

The two drive motors 9 provide for a movement of the device 2 on the surface 1, the two drive wheels 8 being driven with a different speed and/or direction of rotation for a change in the direction of movement.

Figure 3:
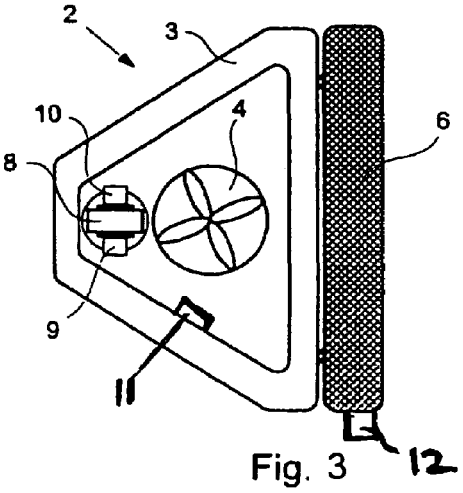
FIG. 3 is a plan view of a second embodiment of the working device according to the invention.

A second embodiment of the device 2 according to the invention having only one drive wheel 8 is shown in FIG. 3. The drive wheel 8 is disposed approximately centrally on that the side of the housing 3 opposite the cleaning device 6 and can be driven by a drive motor 9. In addition, a servomotor 10 is provided, with which the drive wheel 8 can be rotated, together with the drive motor 9, to be able to vary the drive direction of the drive wheel 8 with regard to the housing 3. As such, it is possible to also vary the direction of movement of the device 2 on the surface 1 with only one drive wheel 8.

In such a case, the device 2 rests with the elongated cleaning device 6 and only one drive wheel 8 on the surface 1.

In both exemplary embodiments, the support of the device 2 on the surface 1 is not mechanically redundant and the force of attraction of the device 2 relative to the surface 1 is in a fixed relationship to the pressure force of the cleaning device 6 against the surface 1 so that the pressure force of the cleaning device 6 against the surface 1 can be specifically set by setting the vacuum between the device 2 and the surface 1. Furthermore, control of the pressure force of the cleaning device 6 is possible for the two embodiments, in which case, both the vacuum and the pressure force can be measured, the latter directly by a pressure detecting device 12, as a controlled variable and the output of the fan 4 can be used as a manipulated variable.

With the solution according to the invention, a defined pressure force, which can be set within limits, of the working device or cleaning device 6 can be achieved with very little outlay.

I claim:

1. A device for carrying out work on a surface, comprising:

a housing having edges for forming a substantially closed space with the surface;

a vacuum disposed at said housing and producing a vacuum in said substantially closed space, the produced vacuum attracting the device to the surface;

a working device for treating the surface, said working device connected to said housing;

at least one support connected to said housing for supporting said housing against the surface; and said working device and said at least one support supporting said housing against the surface in a three-point support.

2. The device according to claim 1, wherein:

said working device has a support point;

said at least one support is two supports having support points; and said support points of said two supports and of said working device form an isosceles triangle having a base disposed between said support points of said two supports.

3. The device according to claim 1, wherein:

said at least one support is one support having a support point;

said working device is elongated and has a section with an extension disposed next to said support point of said one support; and said working device supports said housing against the surface along said section.

4. The device according to claim 1, wherein said at least one support is a drive for moving said housing on the surface.

5. The device according to claim 4, wherein said drive has a variable drive direction.

6. The device according to claim 1, wherein said at least one support is a means for moving said housing on the surface.

7. The device according to claim 6, wherein said moving means has a variable drive direction.

8. The device according to claim 1, including a vacuum detecting device for detecting a measure of the vacuum in said substantially closed space.

9. The device according to claim 8, wherein said vacuum detecting device is disposed at said housing.

10. The device according to claim 1, including a pressure detector for detecting a measure of a pressure force of said working device against the surface.

11. The device according to claim 10, wherein said pressure detector is disposed at said housing.

12. A device for carrying out work on a surface, comprising:

a housing having edges for forming a substantially closed space with the surface;

means for producing a vacuum in said substantially closed space, the produced vacuum attracting the device to the surface, said vacuum producing means disposed at said housing;

a working device for treating the surface, said working device connected to said housing;

at least one support connected to said housing for supporting said housing against the surface; and said working device and said at least one support supporting said housing against the surface in a three-point support.

13. A method for operating a device for carrying out work on a surface, which comprises;

providing a housing having:

edges for forming a substantially closed space with the surface;

a vacuum;

a working device for treating the surface, the working device having a support point; and at least one support having a support point for supporting the housing against the surface, the working device and the at least one support supporting the housing against the surface in a three-point support; and activating the vacuum to produce a vacuum in the substantially closed space, the produced vacuum attracting the device to the surface and producing a pressure force against the surface, which pressure force, taking into account a point of application of the pressure force on the housing and a configuration of the support point of the at least one support and of the support point of the working device, leads to a predetermined pressure force of the working device against the surface.

14. The method according to claim 13, which further comprises determining a measure of the vacuum in the substantially closed space with a vacuum detecting device and utilizing the measure as an actual variable for controlling the vacuum.

15. The method according to claim 13, which further comprises determining a measure of the vacuum in the substantially closed space with a pressure detector and utilizing the measure as an actual variable for controlling the vacuum.

16. The method according to claim 13, which further comprises detecting a measure of a pressure force of the working device against the surface with a vacuum detecting device and utilizing the measure to achieve a predetermined value for the measure to control the vacuum.

17. The method according to claim 13, which further comprises detecting a measure of a pressure force of the working device against the surface with a pressure detector and utilizing the measure to achieve a predetermined value for the measure to control the vacuum.

18. A method for operating a device for carrying out work on a surface, which comprises:

providing a housing having:

edges for forming a substantially closed space with the surface;

a vacuum;

a working device for treating the surface, the working device having a support point; and at least one support having a support point for supporting the housing against the surface, the working device and the at least one support supporting the housing against the surface in a three-point support; and activating the vacuum to produce a vacuum in the substantially closed space, the produced vacuum attracting the device to the surface and producing pressure force against the surface and a corresponding predetermined pressure force of the working device against the surface dependent upon a point of application of the pressure force on the housing and a configuration of the support point of the at least one support and of the support point of the working device.

19. A device for carrying out work on a surface, comprising:

a housing;

a vacuum disposed at said housing and producing a vacuum between said housing and the surface;

a working device for treating the surface, said working device connected to said housing;

a support connected to said housing for supporting said housing against the surface; and said working device and said support supporting said housing against the surface in a two point support only including two support points, a first of said support points having a given footprint and a second of said support points being elongated and having a footprint larger than said given footprint.

20. The device according to claim 19, wherein:

said at least one support is said first support point; and said working device is said second support point.

21. A method for operating a device for carrying out work on a surface, which comprises;

providing a housing having:

a vacuum;

a working device for treating the surface, the working device having a first support point; and a support having a second support point for supporting the housing against the surface, the working device and the support supporting the housing against the surface in a two point support only including said first and second support points, one of said first and second said support points having a given footprint and another of said first and second support points being elongated and having a footprint larger than said given footprint; and activating the vacuum to produce pressure force against the surface and a corresponding predetermined pressure force of the working device against the surface dependent upon a point of application of the pressure force on the housing and a configuration of the first and second support points.

* * * * *